US008795598B2

(12) United States Patent
Lawrukovich

(10) Patent No.: US 8,795,598 B2
(45) Date of Patent: Aug. 5, 2014

(54) EXHAUST TREATMENT DEVICE WITH INDEPENDENT CATALYST SUPPORTS

(75) Inventor: Michael Paul Lawrukovich, Flushing, MI (US)

(73) Assignee: Katcon Global S.A., Luxembourg (LU)

( * ) Notice: Subject to any disclaimer, the term of this patent is extended or adjusted under 35 U.S.C. 154(b) by 1342 days.

(21) Appl. No.: 11/862,276

(22) Filed: Sep. 27, 2007

(65) Prior Publication Data

US 2009/0087354 A1 Apr. 2, 2009

(51) Int. Cl.
*B01D 50/00* (2006.01)

(52) U.S. Cl.
USPC ..... 422/179

(58) Field of Classification Search
USPC ..... 422/177, 179, 180
See application file for complete search history.

(56) References Cited

U.S. PATENT DOCUMENTS

| | | | | |
|---|---|---|---|---|
| 4,556,543 | A * | 12/1985 | Mochida et al. | 422/171 |
| 5,108,716 | A * | 4/1992 | Nishizawa | 422/171 |
| 5,811,063 | A | 9/1998 | Robinson et al. | |
| 6,484,397 | B1 | 11/2002 | Collins et al. | |
| 6,953,757 | B2 | 10/2005 | Zoitos et al. | |
| 7,047,641 | B2 | 5/2006 | Hardesty et al. | |
| 7,179,431 | B2 | 2/2007 | Lesher et al. | |
| 2004/0105792 | A1 * | 6/2004 | Worner et al. | 422/180 |
| 2004/0213707 | A1 | 10/2004 | Prommersberger et al. | |
| 2004/0234427 | A1 * | 11/2004 | Tursky | 422/177 |
| 2005/0214178 | A1 * | 9/2005 | LaBarge et al. | 422/180 |
| 2006/0156794 | A1 | 7/2006 | Horn et al. | |
| 2007/0178026 | A1 * | 8/2007 | Roth et al. | 422/177 |

FOREIGN PATENT DOCUMENTS

| | | |
|---|---|---|
| EP | 1361347 A1 | 1/2003 |
| EP | 1715154 A2 | 3/2006 |

OTHER PUBLICATIONS

Unifrax Product Information Sheet, "IsoMat AV Automotivve Catalytic Converter Support Mount System" Aug. 2003 pp. 1-2.
Unifrax Product Information Sheet, "CC-Max 4 HP Substrate Support Mat", Feb. 2004 p. 1-4.
English language abstract and machine-assisted translation for EP 1715154 extracted from espacenet.com database on Aug. 26, 2013, 11 pages.
Communication pursuant to Article 94(3) EPC for Application 08164302.5-1263 / 2042698 dated Oct. 5, 2010, 3 pages.
* cited by examiner

*Primary Examiner* — Tom Duong
(74) *Attorney, Agent, or Firm* — Howard & Howard Attorneys PLLC

(57) ABSTRACT

An exhaust treatment device comprises a housing defining an inlet opening and an outlet opening, a first catalyst brick and a second catalyst brick each having an inlet end and an outlet end, a first insulating support cover, and a second insulating support cover. The first catalyst brick is disposed within a first segment of the housing, and the second catalyst brick is disposed within a second segment of the housing. The first segment has an inner periphery that is not equal to an inner periphery of the second segment. The first and second catalyst bricks each have nonuniform dimensions with respect to one another. The first and second segments of the housing are independently dimensioned in proportion to the first and second catalyst bricks respectively. The first insulating support cover is disposed within the first segment of the housing in a first annular space between an inner surface of the housing and an exterior surface of the first catalyst brick. The second insulating support cover is disposed within the second segment of the housing in a second annular space between the inner surface of the housing and an exterior surface of the second catalyst brick. The first and second insulating support covers are independently dimensioned in proportion to the first and second catalyst bricks respectively.

14 Claims, 2 Drawing Sheets

EXHAUST TREATMENT DEVICE WITH INDEPENDENT CATALYST SUPPORTS

BACKGROUND

Exemplary embodiments of the present invention relate to a catalyst support system for an exhaust treatment device. More particularly, exemplary embodiments of the present invention relate to independent catalyst support systems.

Catalytic converters are devices that operate to reduce the toxicity of exhaust emissions from internal combustion engines by providing an environment for a chemical reaction involving catalysts in which toxic combustion byproducts (for example, hydrocarbons, in the form of unburned gasoline, carbon monoxide, formed by the combustion of gasoline, and nitrogen oxides, created when heat in an engine forces nitrogen in the air to combine with oxygen) are converted to less-toxic gases. Such devices have utility in a number of fields, including the treatment of exhaust gas streams from automobile, truck, and other internal combustion engines.

A catalytic converter generally comprises one or more catalysts (most often comprising a precious metal component such as platinum deposited on a refractory metal oxide support such as gamma-alumina), a catalyst support (a ceramic or metal carrier material typically comprising a substrate such as cordierite) which carries the catalysts, and a washcoat (to which the catalysts are added before application to the support to make converters more efficient). The catalyst serves to catalyze, for example, the oxidation of carbon monoxide, a poison for any air-breathing animal, to carbon dioxide, the oxidation of hydrocarbons, which produce smog, to carbon dioxide and water, and the reduction of nitrogen oxides, which lead to smog and acid rain, back to nitrogen and oxygen.

Current catalytic converters can utilize multiple catalysts and will typically have multiple independent catalyst "bricks," that is, catalysts which are carried on a porous support and coated on a substrate disposed within the housing. Some bricks have a plurality of cells providing fluid paths therethrough. The catalyst bricks are generally retained in a converter housing or shell by a compressible mat support material, which is disposed between the exterior of the catalyst bricks and the interior surface of the housing. The compressible support material exerts a retaining force or pressure upon the catalyst bricks. The amount of support desired for each catalyst brick individually may be dissimilar from that of the other catalyst bricks because the catalyst bricks may have inconsistent exterior dimensions and/or compositions with respect to one another, or because the dimensions of the catalytic converter housing may be asymmetrical, so that the areas between the exterior surface of each individual catalyst brick and the interior surface of the converter are inconsistent. Nevertheless, current catalytic converters employ a singular, uniform support blanket, or mat, to secure the multiple catalyst bricks.

The proper mat pressure on a catalyst brick is obtained by taking into consideration the type of mat material or materials, the "gap bulk density" (GBD) for the mat in the annular space it occupies between the catalyst brick and the housing under loading (e.g., compressive force), the mass of the catalyst brick and thus the required support from the mat material (e.g., retention pressures based upon basis weight and/or thermal properties) can vary for each brick, the vibrational loads which the catalyst brick must withstand, the coefficient of friction between the mat and housing and between the mat and catalyst brick, the rate of mat compression during assembly of the exhaust treatment device, and the amount of any over compression of the mat during assembly. Thus, as mentioned above two independent catalyst bricks with a single support mat may not provide the most desired support for each brick since each independent and distinct brick may require different support requirements (e.g., insulative, pressure, erosion, etc.).

Mat support materials are produced in different "basis weights," that is, mat weight per unit area (e.g., grams/meter$^2$). The mat basis weight selected depends on the brick-to-housing annular space, the tolerance range of the substrate and the shell, and other factors such as the mat thickness required to attain the desired support based upon the mass of the brick, cell size, thermal expansion coefficients and the desired temperature for the outer surface of the housing (e.g., insulation requirements).

The gap bulk density (GBD) typically provided in grams per cubic centimeter ("g/cc") is one of the most important characteristics considered during the design of an exhaust treatment device because it is an indicator of the pressure on the brick, brick retention force, force on the brick due to mat expansion during vehicle operation or temperature changes, and the rate of mat erosion. The GBD can be obtained for a particular gas treatment device assembly by determining the annular space or "annulus" between the catalyst brick and the inner housing surface, together with the mat's basis weight. The GBD defines the level of mat compression in grams per cubic centimeter (g/cm3).

Variations between the catalyst bricks within a catalytic converter housing of uniform shape, or within a nonuniformly shaped converter housing in some instances, can produce variations in the annulus between the individual catalyst bricks and the inner surface of the housing. When variations such as these cause the annular space to reach a minimum (the "minimum annulus condition"), a condition of maximum gap bulk density is produced. Under this condition, the mat pressure on a catalyst brick can become high enough to cause the brick's substrate to fracture. Since substrates account for about 90% of the total cost of an exhaust treatment device, it is desirable to minimize or eliminate these fractures.

Since excessive mat forces may cause the substrate to fracture, it is desirable to limit the maximum gap bulk density for each catalyst brick individually to ensure proper substrate retention without causing fractures and to limit mat erosion to acceptable levels. Nevertheless, the insulating support system currently used for exhaust treatment devices that utilize multiple catalyst bricks does not specifically account for differences in characteristics such as size, weight, thermal insulation properties, and exhaust gas erosion properties between the mat support and the individual catalyst bricks.

Accordingly, it is desirable to provide a catalyst support system for exhaust treatment devices that utilize multiple catalyst bricks that can account for the dissimilarities in the amount of support desired for each of the catalyst bricks individually.

SUMMARY OF THE INVENTION

In accordance with exemplary embodiments of the present invention, an exhaust treatment device is provided. The exhaust treatment device comprises a housing defining an inlet opening and an outlet opening, a first catalyst brick and a second catalyst brick each having an inlet end and an outlet end, a first insulating support cover, and a second insulating support cover. The first catalyst brick is disposed within a first segment of the housing, and the second catalyst brick is disposed within a second segment of the housing. The first segment has an inner periphery that is not equal to an inner periphery of the second segment. The first and second catalyst bricks each have nonuniform dimensions with respect to one another. The first and second segments of the housing are independently dimensioned in proportion to the first and second catalyst bricks respectively. The first insulating support cover is disposed within the first segment of the housing in a first annular space between an inner surface of the housing and an exterior surface of the first catalyst brick. The second insulating support cover is disposed within the second segment of the housing in a second annular space between the inner surface of the housing and an exterior surface of the second catalyst brick. The first and second insulating support covers are independently dimensioned in proportion to the first and second catalyst bricks respectively.

In accordance with exemplary embodiments of the present invention, an exhaust treatment device is provided. The exhaust treatment device comprises a shell portion defining an inlet opening and an outlet opening, a plurality of catalyst bricks each having an inlet end and an outlet end, and a plurality of independent insulating support covers. The housing has a plurality of segments. Each catalyst brick of the plurality of catalyst bricks is disposed within a respective segment of the plurality of segments of the housing. Each segment of the plurality of segments has an inner periphery that is nonuniform with respect to the other segments of the plurality of segments. Each catalyst brick of the plurality of catalyst bricks has nonuniform dimensions with respect to the other catalyst bricks of the plurality of catalyst bricks. Each segment of the plurality of segments is independently dimensioned in proportion to the respective catalyst brick of the plurality of catalyst bricks. Each insulating support cover is disposed within a respective segment of the plurality of segments of the housing in a corresponding annular space between an inner surface of the housing and an exterior surface of the respective catalyst brick. Each insulating support cover of the plurality of independent insulating support covers is independently dimensioned in proportion to the respective catalyst brick of the plurality of catalyst bricks.

In accordance with exemplary embodiments of the present invention, a method for providing an exhaust treatment device for an internal combustion engine is provided. The method comprises annularly disposing each of a plurality of independent insulating support covers about a respective catalyst brick of a plurality of catalyst bricks to form a plurality of subassemblies; and inserting each subassembly of the plurality of subassemblies within a respective segment of a plurality of segments of a housing, the housing defining an inlet opening and an outlet opening. Each catalyst brick of the plurality of catalyst bricks has nonuniform dimensions with respect to the other catalyst bricks of the plurality of catalyst bricks. Each segment of the plurality of segments is independently dimensioned in proportion to the respective catalyst brick of the plurality of catalyst bricks. Each segment of the plurality of segments has an inner periphery that is nonuniform with respect to the other segments of the plurality of segments. Each insulating support cover of the plurality of independent insulating support covers is independently dimensioned in proportion to the respective catalyst brick of the plurality of catalyst bricks.

In accordance with exemplary embodiments of the present invention, an exhaust treatment device is provided. The exhaust treatment device comprises An exhaust treatment device, comprising: a housing defining an inlet opening and an outlet opening; a first catalyst brick and a second catalyst brick each having an inlet end and an outlet end, the first catalyst brick being disposed within a first segment of the housing and the second catalyst brick being disposed within a second segment of the housing, a mass of the first catalyst brick being less than a mass of the second catalyst brick; a first insulating support cover disposed within the first segment of the housing in a first annular space between an inner surface of the housing and an exterior surface of the first catalyst brick; and a second insulating support cover disposed within the second segment of the housing in a second annular space between the inner surface of the housing and an exterior surface of the second catalyst brick, the first and second insulating support covers being independently dimensioned in proportion to the first and second catalyst bricks respectively, the first segment of the housing being independently dimensioned in relation to the first catalyst brick and the first insulating support cover, the second segment of the housing being independently dimensioned in relation to the second catalyst brick and the second insulating support cover.

DETAILED DESCRIPTION OF EXEMPLARY EMBODIMENTS

Figure 1:
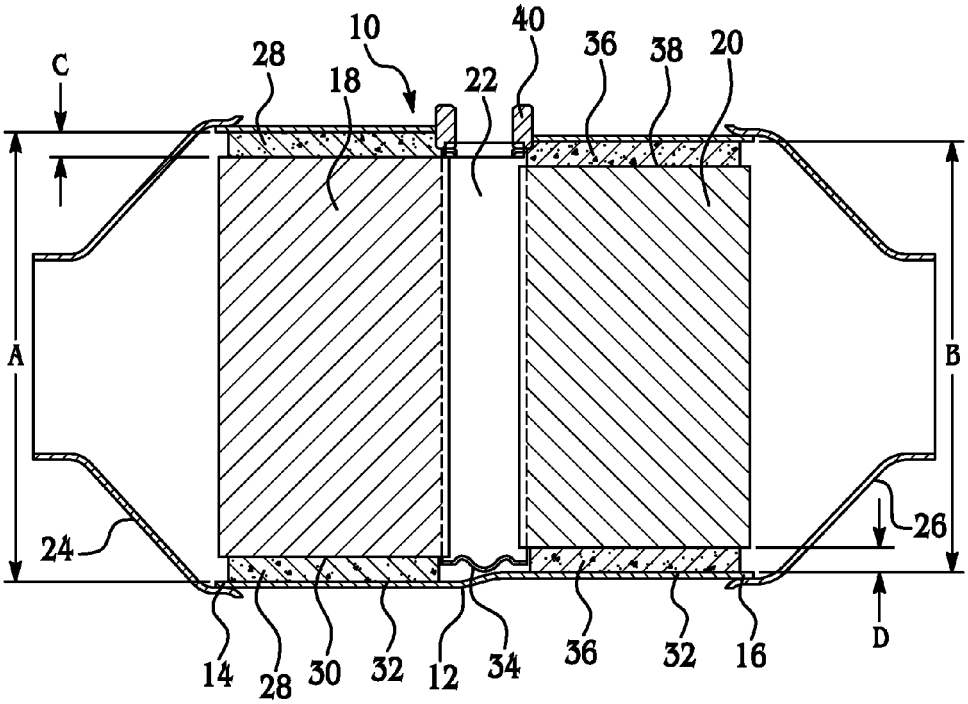
FIG. 1 is a cross-sectional view of a catalytic converter constructed in accordance with an exemplary embodiment of the present invention.

Exemplary embodiments of the present invention relate to the incorporation of independent insulating support mats into an internally insulated catalytic converter or exhaust treatment device that utilizes multiple catalyst bricks. This incorporation of independent insulating support mats allows for the insulating support material disposed between the exterior of the independent catalyst bricks and the interior surface of the converter housing shell, as well as the dimensions of the housing shell, to be configured for each particular catalyst brick individually. This is in contrast to catalytic converters that use one support mat to secure multiple catalysts or bricks. Accordingly, using independent support mats allows for sizing to be optimized for each catalyst for length, width and basis weight to reduce costs. For example, the front catalyst brick is typically smaller and lower in mass than the rear catalyst brick or down stream brick thus a lower basis weight material can be used to reduce costs. Also and since less material is required since only one brick is being supported a premium support material (e.g., more resistant to exhaust gas erosion or higher thermal insulative qualities) can be used for the leading catalyst. In addition, the support requirements for the rear catalyst brick will be less than both bricks combined and will thus allow for a lower basis weight material. Furthermore, the rear support requirements for erosion resistance will be lower with the reduced or eliminated exhaust gas impingement since the exhaust gases with contact the support mat for the front or leading catalyst brick first.

Separate support materials will allow catalyst of different diameters to accommodate for using "size to fit" assembly techniques for each of the independent bricks based upon cell sizing (e.g., the size of the openings or channels passing through the brick), thermal expansion or other features as deemed necessary. Moreover, and since there are at least two independent supporting mats there will be a gap between the two which will further reduce the amount of material required.

Exemplary embodiments of the present invention can thereby improve function, provide thermal durability, and reduce costs by accounting for the distinct sizing, required thermal insulation, exhaust gas erosion, and/or other properties of each catalyst brick. Furthermore, the independent support mats can be optimized for cost based upon length, width, basis weight and material type required, wherein one brick may require a different type of support mat thus each support mat can be distinctly associated with each brick thus minimizing assembly costs. For example, a more expensive support mat may be used for the leading or inlet brick and a less expensive support mat may be used for the downstream or second catalyst brick, wherein more expensive and less expansive support mats are defined by the materials required to provide the required support, performance and durability as well as amount of material required. In addition and based upon the catalyst cell size requirements of the individual bricks the housing can be sized to accommodate the same as well as provide the required gap bulk density to the individual bricks as well as the required support pressures which are in part determined by the size of the cells of the catalyst bricks as well as the thermal expansion properties of the system components.

The incorporation of independent insulating support mats in exemplary embodiments can also offer substantial assembly benefits over catalytic converters that employ a singular catalyst support mat for multiple catalyst bricks.

Referring now to the exemplary embodiment illustrated in FIG. 1, a cross-sectional view of a catalytic converter having a pair of non-butted (that is, spaced) bricks positioned in a facing spaced relationship within a housing to provide a clearance or area for installation of, for instance, a gas sensor between the outlet end of a first catalyst brick and before the inlet end of a second catalyst brick, is provided. The exemplary catalytic converter 10 of FIG. 1 is provided with an outer shell or housing 12. Housing 12 is configured to have an inlet end 14 and an outlet end 16. Proximate to the inlet end is a first or front catalyst brick 18 and spaced therefrom is a second or rear catalyst brick 20.

In the present exemplary embodiment, front catalyst brick 18 is provided with a larger outer periphery or circumference than rear catalyst brick 20, and to accommodate this difference, housing 12 is configured to have a larger outer periphery or circumference in the section disposed about front catalyst brick 18, indicated by distance A in FIG. 1, than the section disposed about rear catalyst brick 20, indicated by distance B. In this embodiment, the front support mat and the rear support mat comprise materials that will provide the desired gap bulk density as well as other qualities for each respective brick when the catalyst bricks are inserted into the housing. As shown, the width of the annular space between an exterior surface 30 of front catalyst brick 18 and an interior surface 32 of housing 12, indicated by distance C in FIG. 1, is substantially uniform with the width of the annular space between an exterior surface 38 of rear catalyst brick 20 the interior surface of the housing, indicated by distance D. Accordingly and in accordance with exemplary embodiments of the present invention the first insulating mat and the second insulating mat are the same type of material, basis weight, thermal properties etc. however, each mat is independently dimensioned for its respective catalyst brick and the housing is configured to provide the desired area and accordingly pressure upon the mat and ultimately the brick to provide the desired amount of support. Alternatively, and in accordance with exemplary embodiments of the present invention the first insulating mat and the second insulating mat have different types of material or materials, basis weights, thermal properties etc. and each mat is independently dimensioned for its respective catalyst brick and the housing is configured to provide the desired area and accordingly pressure upon the mat and ultimately the brick to provide the desired amount of support.

It should be appreciated that, in other non-limiting exemplary embodiments, subtle variations in widths C and D may be present due to manufacturing imprecision. Furthermore, the widths C and D may vary due to the configurations and materials used for the brick and/or the configurations and materials used for the insulative mats.

In accordance with exemplary embodiments of the present invention, the front support mat and the rear support mat may each comprise a different insulating material having varying densities, basis weights and thermal qualities, which correspond to the independent catalyst bricks, which themselves may each have different qualities requiring different support from the insulating material. One non-limiting example of different qualities is the cell sizes of the bricks wherein larger cell sizes may make the brick less tolerant to higher support pressures.

For example and as illustrated, several independent substrates are employed thereby enabling the use of different substrate and/or catalyst materials in different areas of the housing. Accordingly, these substrates may require different insulating mats or specific applied pressures or forces from the insulating mats in order to retain the bricks within the housing. This may be achieved by compressing the insulating mat in the annular space between the housing and the brick in order to achieve the desired gap bulk density. Moreover, different mat materials (e.g., different basis weights) may be employed to provide the desired gap bulk density between the independent catalyst bricks. Also, the different thermal properties of the mat materials will provide differences in thermal expansion between the mat, the housing and the catalyst bricks, wherein the material of mats can be selected to provide different rates of thermal expansion specifically designed for the brick being supported by the mat. In other words, the different rates of thermal expansion will cause the mats to apply different expansion pressures to the brick and accordingly one insulating support cover has a different rate of thermal expansion than the second insulating support cover and expansion pressure applied to the first catalyst brick by the first insulating support cover is less than or greater than expansion pressure applied to the second catalyst brick by the second insulating support cover. As illustrated in FIG. 1, a gap 22 is provided between each of the bricks wherein a gas sensor (not shown) may be secured within a threaded opening 40 that is proximate to the gap. Also depicted are a first end cone 24 and a second end cone 26, each of which is secured to housing 12 after front and rear catalyst bricks 18, 20 are installed in the housing.

In the exemplary embodiment illustrated in FIG. 1, front and rear bricks 18, 20 are retained in housing 12 and respectively supported by front and rear independent insulating support mats 28, 36. Front support mat 28 is annularly wrapped around exterior surface 30 of front catalyst brick 18 and disposed in the annular space between the front catalyst brick and interior surface 32 of housing 12. Rear support mat 36 is annularly wrapped around exterior surface 38 of rear catalyst brick 20 and disposed in the annular space between the rear catalyst brick and interior surface 32 of housing 12.

In the present exemplary embodiment, each independent support mat is specifically configured to support the corresponding catalyst brick around which it is disposed. The use of multiple insulating support mats enables the use of support mats having different dimensions and/or comprising different materials within housing 12. For instance, while front and rear support mats 28, 36 are shown in FIG. 1 as being substantially uniform in annular width (or thickness), the front support mat is provided with a larger outer circumference than the rear support mat to correspond with the larger outer circumference of front catalyst brick 18. The front and rear support mats 28, 36 can thereby be utilized to provide consistent insulating properties for their respective catalyst bricks independently, as well as a snug fit in the annular space between housing 12 and the respective catalyst brick.

Accordingly and in accordance with exemplary embodiments of the present invention the first insulating mat and the second insulating mat are the same type of material basis weight, thermal properties etc. however, each mat is independently dimensioned for its respective catalyst brick due to non-uniformity between them and the housing is configured to provide the desired area and accordingly pressure upon the mat, and ultimately the brick, to provide the desired amount of support. Alternatively, and in accordance with exemplary embodiments of the present invention the first insulating mat and the second insulating mat have different types of material or materials, basis weights, thermal properties etc. and each mat is independently dimensioned for its respective catalyst brick and the housing is configured to provide the desired area and accordingly pressure upon the mat, and ultimately the brick, to provide the desired amount of support.

Furthermore, the front and rear support mats 28, 36 can be utilized to provide insulating and support properties for their respective catalyst bricks independently, which allows the mats to comprise different basis weights and materials suitable for the specific performance of each brick.

In exemplary embodiments, catalyst bricks 18, 20 and housing 12 can be assembled together using a tourniquet, size-to-fit, or stuffing process whereby each catalyst brick is annularly wrapped with its respective insulating support mat and inserted into the housing. In an exemplary embodiment, to provide gap 22 as illustrated in FIG. 1, front brick 18 can first be inserted into inlet end 14 of housing 12, then a ring or spacer 34 can be inserted into outlet end 16 of the housing, and thereafter rear brick 20 can be inserted into the housing from the same end as ring 34 to sandwich the ring between the front brick and the rear brick. In an alternative exemplary embodiment, rear brick 20 can first be inserted into inlet end 14 of housing 12, then the ring 34 can be inserted into the inlet end of the housing, and thereafter front brick 18 can be inserted into the housing from the same end as the rear brick and the ring to sandwich the ring between the rear brick and the front brick.

The use of multiple catalyst bricks enables the use of bricks having different catalyst dimensions and/or materials in different areas of the housing. In exemplary embodiments in which multiple catalyst bricks having nonuniform dimensions are utilized, such as in FIG. 1, the dimensions of the housing and/or the dimensions of the independent support mats likewise can be nonuniform to accommodate the variations in dimensions between the multiple catalyst bricks. Thus, multiple insulating support mats can be utilized to provide a desired and/or consistent amount of support to multiple catalyst bricks, even where the catalyst bricks are of nonuniform dimension and disposed a housing shell that has varying dimensions corresponding to those of the multiple catalyst bricks.

It should thus be understood that the size, shape, and configurations of each catalyst brick, each insulting support, the first end cone, the second end cone, and the elongated housing portion or shell may all vary in accordance with exemplary embodiments of the present invention. It should also be understood that an exhaust treatment device in accordance with the present invention may contain more than two catalyst bricks. Therefore, in exemplary embodiments in which more than two catalyst bricks of varying dimensions and/or configurations are used, the dimensions and/or materials of more than two independent insulating support mats disposed about the multiple catalyst bricks can vary in accordance with the varying dimensions and configurations of the catalyst bricks, and the dimensions of the housing shell can vary in accordance with the both the dimensions of the multiple catalyst bricks and the dimensions of the insulating support mats.

Additionally, exemplary embodiments of the present invention can be directed to various types of exhaust treatment devices. For instance, exemplary embodiments can involve, a three-way catalytic washcoat that absorbs $NO_x$. Other exemplary embodiments can involve a first insulating support mat disposed about and configured to provide a desired amount of support for a diesel particulate filter and a second insulating support mat disposed about and configured to provide a desired amount of support for a catalyst brick with the same housing.

In exemplary embodiments, the housing can comprise a material that is capable of withstanding the type of gas, maximum temperature of the gas, maximum temperatures reached by the catalyst bricks, as well as other related operating conditions including, but not limited to, under car salt exposure, temperature, corrosion, and the like. Generally, ferrous materials are employed, such as ferritic stainless steels, and the like. Some possible ferritic stainless steels can include stainless steel grades such as the 400-Series, for example, SS-409, SS-439 and SS-441, with grades SS-409 and SS-439 preferred.

Exemplary embodiments of catalyst bricks of the present invention can include a catalyst support preferably deposited on a substrate and, optionally, one or more precious metal components. The precious metal component(s) may comprise, for example, platinum, palladium, rhodium and mixtures thereof. The catalyst supports can include a high surface area refractory metal oxide, which is well known in the prior art. Typical refractory metal oxides will have a specific surface area of about 60 to about 300 $m^2/g$. Examples of suitable refractory metal oxides include alumina, titania, zirconia, and mixtures of alumina with one or more of titania, zirconia, ceria, baria, and a silicate. A preferable refractory metal oxide comprises gamma-alumina.

In exemplary embodiments, the substrate (or "carrier") on which the catalyst support is deposited can comprise any material designed for use in a spark ignition or diesel engine environment, and which has the following characteristics: (1) capable of operating at temperatures up to, and exceeding, about 1,000 degrees Celsius (depending upon the location of the treatment device; for example, under-floor, close coupled, in the manifold, and the like); (2) capable of withstanding exposure to hydrocarbons, nitrogen oxides, carbon monoxide, carbon dioxide, sulfur, particulates, and/or sulfur oxides; and, if desired, (3) having sufficient surface area and structural integrity to support the desired catalyst.

Typically, the substrate is a suitable refractory ceramic or metal having a honeycomb geometry, with the combs being any multisided or rounded shape, with substantially square, triangular, pentagonal, hexagonal, heptagonal, or octagonal or similar geometries preferred due to ease of manufacturing and increased surface area. Examples of possible materials include cordierite, cordierite-α-alumina, silicon nitride, silicon carbide, silicon carbonitride replica, zircon mullite, spodumene, alumina-silica-magnesia, zircon silicate, sillimanite, a magnesium silicate, zircon, petalite, α-alumina, an aluminosilicate, and the like, as well as combinations comprising at least one of the foregoing materials. Cordierite is preferred. Some ceramic materials include "HONEY CERAM", commercially available from NGK-Locke, Inc, Southfield, Mich., and "CELCOR", commercially available from Corning, Inc., Corning, N.Y. These materials can be in the form of foils, porous structures (for example, porous glasses or sponges), monoliths (for example, a honeycomb structure), and the like, as well as combinations comprising at least one of the foregoing forms. Although the substrate can have many different sizes and geometries, the size and geometry are preferably chosen to optimize surface area within the given gas treatment device design parameters.

In exemplary embodiments, a suitable substrate can be a monolithic carrier of the type having fine, parallel gas flow channels extending therethrough from an inlet or an outlet face of the carrier, such that channels are open to fluid flow therethrough. The small channels are coated with a high-surface area washcoat and one or more catalysts. The catalyst may comprise one or more catalyst materials that are wash coated, imbibed, impregnated, physisorbed, chemisorbed, precipitated, or otherwise applied to the substrate. The particular catalyst(s) are chosen based upon the type of gas treatment device and its location in the vehicle. Possible catalyst materials include noble metals, such as platinum, palladium, rhodium, iridium, osmium, and ruthenium; other metals, such as tantalum, zirconium, yttrium, cerium, nickel, copper, and the like; active carbon, titanium dioxide and the like; and metal oxides, alloys, mixtures comprising at least one of the foregoing catalysts, and the like. The catalyst can optionally include a base metal oxide for the reduction of nitrogen oxides. The catalyst promotes desired chemical reactions without taking part in the reactions.

To function with significant efficiency, a catalytic converter must be warmed by the engine exhaust flow to a minimum operating temperature. This is normally about 350 degrees Celsius or higher for automotive catalytic converters with gasoline engines. When operating at these temperatures or above, at a stoichiometric air/fuel ratio, a catalytic converter will simultaneously oxidize and reduce engine exhaust gas contaminates such as hydrocarbons, nitrogen oxides and carbon monoxide into compounds such as carbon dioxide, nitrogen and water. For diesel engine applications, hydrocarbons, carbon monoxide, and the volatile portion of diesel particulates are oxidized by diesel oxidation catalysts, starting at temperatures as low as 150 degrees Celsius, to form harmless byproducts. In addition, catalyzed diesel particulate filters, or "traps," capture the nonvolatile components of diesel particulates for oxidation under higher temperature conditions. The reduction of oxides of nitrogen, however, is more difficult due to the presence of oxidizing conditions in normal diesel exhaust.

As described above, and in accordance with exemplary embodiments of the present invention, a respective independent insulating support mat can be provided for each of the multiple catalyst bricks and disposed in the annular space between the corresponding catalyst brick and the exhaust treatment device's housing. Each independent support mat can be configured to specifically support the corresponding catalyst brick around which it is disposed. The support mats can serve to insulate the housing from both the high exhaust gas temperatures and the exothermic catalytic reaction occurring within the catalyst bricks, which may vary between the bricks due to their inherent qualities. Each support mat, which can enhance the structural integrity of the corresponding catalyst brick by applying specific desired compressive radial forces about it, thereby reducing the axial movement of the catalyst brick and retaining it in place, can be concentrically disposed or annularly wrapped around the catalyst brick to form a support mat/catalyst brick subassembly. Accordingly and since independent mats are employed, insulative mats of differing materials, basis weights, thermal properties, erosion resistant properties, etc. are capable of being used for each independent and distinct brick, wherein one mat may react differently to thermal changes than the other mat. Alternatively, the first insulating mat and the second insulating mat are the same type of material basis weight, thermal properties etc. however, each mat is independently dimensioned for its respective catalyst brick due to non-uniformity between them and the housing is configured to provide the desired area and accordingly pressure upon the mat, and ultimately the brick, to provide the desired amount of support.

Therefore, in exemplary embodiments in which a first catalyst brick has a larger outer circumference than a second catalyst brick, a first insulating support mat could be provided with a larger outer circumference so that it may be annularly disposed around the first catalyst brick, while the second insulating support mat can be provided with a smaller outer circumference so that it may be annularly disposed around the second catalyst brick. A housing shell can then be provided that has a larger outer periphery or circumference in a first section to accommodate the first support mat/catalyst brick subassembly and a smaller outer periphery or circumference in a second section to accommodate the second support mat/catalyst brick subassembly. The insulating support mats can thus be configured in exemplary embodiments with substantially uniform annular widths and nonuniform outer circumferences so that each insulating support mat fits within the specific annular space between the corresponding catalyst brick and the section of the housing shell where that catalyst brick is disposed.

Moreover, in alternative exemplary embodiments of the present invention, housings having asymmetrical, complex, cross-sectional geometries may be employed without significantly affecting or causing substantial variations in the gap bulk density across the exhaust treatment device. The flexibility and structural integrity provided by the use of independent insulating support mats can permit a converter housing to have cell sizing that is independent of the dimensions of the multiple catalyst bricks. That is, the size and shape of the housing is not required to directly correspond to the size and shape of each catalyst brick that is disposed within the housing. Rather, in exemplary embodiments, each insulating support mat can be provided with dimensions (for example, length, annular width or thickness, and/or outer circumference) that specifically correspond to the dimensions of the annular space between the respective catalyst and the housing in which it will be disposed.

Each support mat can comprise either an intumescent material or a nonintumescent material. An intumescent material, for example, is one which contains ceramic materials, other conventional materials such as organic binders and the like, or combinations comprising at least one of the foregoing materials, and a vermiculite component that expands with heating to maintain firm uniform compression, or nonuniform compression, if desired. A nonintumescent material, for example, does not contain vermiculite. Exemplary nonintumescent materials include materials such as those sold under the trademarks "NEXTEL," "SAFFIL" and "INTERAM 1101 HT" by the "3M" Company, Minneapolis, Minn., those sold under the trademark, "FIBERFRAX" and "CC-MAX" by the Unifrax Co., Niagara Falls, N.Y., and the like. Exemplary intumescent materials include materials such as those sold under the trademark "INTERAM 100" by the "3M"

Company, Minneapolis, Minn., those sold under the aforementioned "FIBERFRAX" trademark, and combinations thereof. These mat materials function to compress and conform to adjust for manufacturing tolerances, retaining a catalyst brick within the housing and sealing the area between the brick and the housing so that exhaust gases do not bypass the catalyst. Normally, this mat material, which can be from about 1 to 10 millimeters (mm) thick, is cut from a large sheet so as to produce a tongue feature at one end of the mat and a matching groove at the other end. The support mat, once cut, is wrapped about the periphery of the corresponding catalyst brick so that the tongue and groove fit together to form a seal at the resulting joint and thereby avoid exhaust gas bypass of the substrate channels even when the periphery varies in size due to tolerances.

After wrapping the mat around the corresponding catalyst brick, the insulating support/catalyst brick subassembly can be installed within the housing one of several non-limiting, exemplary processes. In the "stuffing" process, for example, a funnel-shaped "stuffing cone" is used to compress the mat as the subassembly is pushed through the cone and into the housing of the exhaust treatment device. In the exemplary "clamshell" assembly process, two half-shells with common connecting flanges are used. A mat-wrapped brick is placed into the first clamshell, and then the second clamshell is placed on top of the first one so that the flanges are aligned. A machine then compresses the clamshells together, and the flanges are welded securely. In the exemplary "tourniquet" process, a mat-wrapped brick is placed into a partially-formed, unwelded shell. A machine pulls on the edges of the shell until a selected load or diametrical distance is reached, and the shell is then welded together.

When installing an insulating support/catalyst brick subassembly having multiple catalyst bricks in a singular support mat using one of the above described processes, as well as when using other exemplary processes, the bricks can easily become misaligned with one another prior to being inserted into the shell, particularly where the multiple catalyst bricks are of nonuniform dimensions with respect to one another. If the bricks are not aligned following installation, they tend to remain misaligned within the shell. Misalignment can cause higher mat pressure on the catalyst bricks by causing adjacent bricks to push each other in opposing directions (that is, further into the support mat). The increased pressure resulting from this condition can be great enough to shear off a section of a brick.

Exemplary embodiments of the present invention, however, can alleviate the misalignment problem by permitting the insertion of multiple catalyst bricks in multiple steps. Because each independent support mat can be wrapped around a single corresponding catalyst brick, each individual catalyst brick can be inserted into the housing as part of a separate insulating support/catalyst brick subassembly in a separate step. Moreover, in exemplary installation processes, the multiple catalyst bricks are not required to all be inserted from the same end of the housing. For instance, for a housing having varying dimensions wherein a first section at a first end has a larger outer periphery or circumference than a second section at a second end, a first catalyst brick having a larger outer circumference than a second catalyst brick could be inserted into the housing through the first end, and the second catalyst brick could be inserted into the housing through the second end. These two insertion steps could occur in sequence such that the first catalyst brick is inserted before the second catalyst brick, in the opposite order, or simultaneously. If independent support mats were not utilized, both catalyst bricks would be inserted through the larger first end in a single step during installation, with the second catalyst brick leading the first catalyst brick, and the risk of misalignment would be increased.

Therefore, the use of independent support mats in exemplary embodiments of the present invention can reduce pressure typically caused during installation of multiple catalyst bricks having dissimilar dimensions and compositions, while also reducing coverage costs. Moreover, each support mat can be independently designed with dimensions and/or materials suitable for the characteristics of a specific catalyst brick, thereby permitting multiple catalyst bricks having inconsistent thermal expansion properties to undergo independent longitudinal and radial movement in exhaust treatment devices. This can alleviate tangential forces caused by temperature differentials across a catalytic converter housing shell that occur during, for example, warm-up when a singular, uniform support mat is used.

Figure 2:
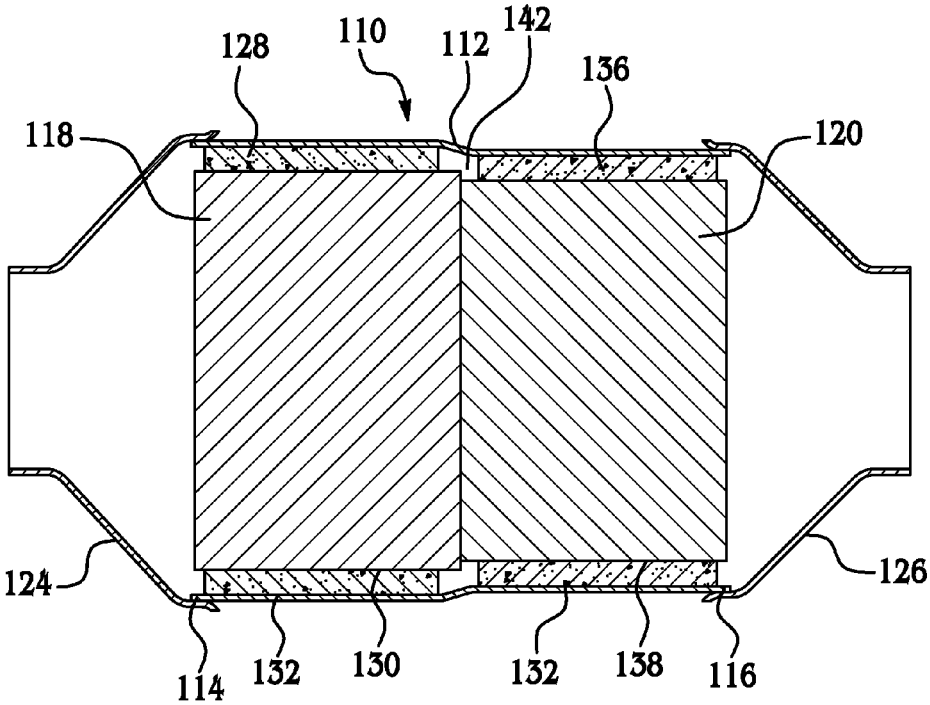
FIGS. 2 and 3 are schematic illustrations of catalytic converters constructed in accordance with alternative exemplary embodiments of the present invention.

In accordance with an exemplary embodiment of the present invention, a catalytic converter having a butted brick design is illustrated in FIG. 2. Exemplary catalytic converter 110 has an outer shell or housing 112 configured to have an inlet end 114 and an outlet end 116. Proximate to the inlet end is a front catalyst brick 118 and adjacent thereto is a rear catalyst brick 120. Front catalyst brick 118 is shown having a larger outer circumference than rear catalyst brick 120, and, to accommodate this difference, housing 112 is configured to have a larger outer periphery in the section disposed about front catalyst brick 118 than the section disposed about rear catalyst brick 120.

The exemplary catalytic converter of FIG. 2 is preferably assembled using the stuffing method. In an exemplary embodiment of this method, front catalyst brick 118 can be pushed into housing 112 through inlet end 114, and rear catalyst brick 120 can be pushed into housing 112 through outlet end 116 until the outlet end of the front catalyst brick is butted against the inlet end of the second catalyst brick. In an alternative exemplary embodiment, rear catalyst brick 120 can first be pushed into housing 112 through inlet end 114, and then front catalyst brick 118 can be pushed into housing 112 through the same inlet end until the outlet end of the front catalyst brick is butted against the inlet end of the second catalyst brick. The butted brick design can offer improved performance while reducing component and manufacturing cost.

Also depicted in FIG. 2 are first and second end cones 124, 126, each of which is secured to housing 112 after front and rear catalyst bricks 118, 120 are positioned in the housing.

In the exemplary embodiment illustrated in FIG. 2, front and rear bricks 118, 120 are retained in housing 112 and supported by front and rear independent insulating support mats 128, 136 respectively. Front support mat 128 is annularly wrapped around exterior surface 130 of front catalyst brick 118 and disposed in the annular space between the front catalyst brick and interior surface 132 of housing 112. Rear support mat 136 is annularly wrapped around exterior surface 138 of rear catalyst brick 120 and disposed in the annular space between the rear catalyst brick and interior surface 132 of housing 112. Prior to being inserted into housing 112, front and rear support mats 128, 136 were disposed about front and rear catalyst bricks 118, 120 respectively, thereby forming two insulating support/catalyst brick subassemblies. As shown, while front and rear catalyst bricks 118, 120 are butted when assembled within housing 112, front support mat 128 is not adjacent to, or butted with, rear support mat 136. Rather, a gap 142 is provided between the front and rear support mats, thus resulting in the use of less overall insulating material than would be were the embodiment designed to utilize a singular catalyst support mat to insulate both catalyst bricks.

Each independent support mat is configured to specifically support the corresponding catalyst brick around which it is disposed. For instance, while front and rear support mats 128, 136 are shown in FIG. 2 as being substantially uniform in length and annular width (or thickness), the front support mat is provided with a larger outer circumference than the rear support mat. The front and rear support mats can thereby be utilized to provide consistent insulating properties for their respective catalyst bricks as well as a snug fit in the annular space between housing 112 and the respective catalyst brick.

Figure 3:
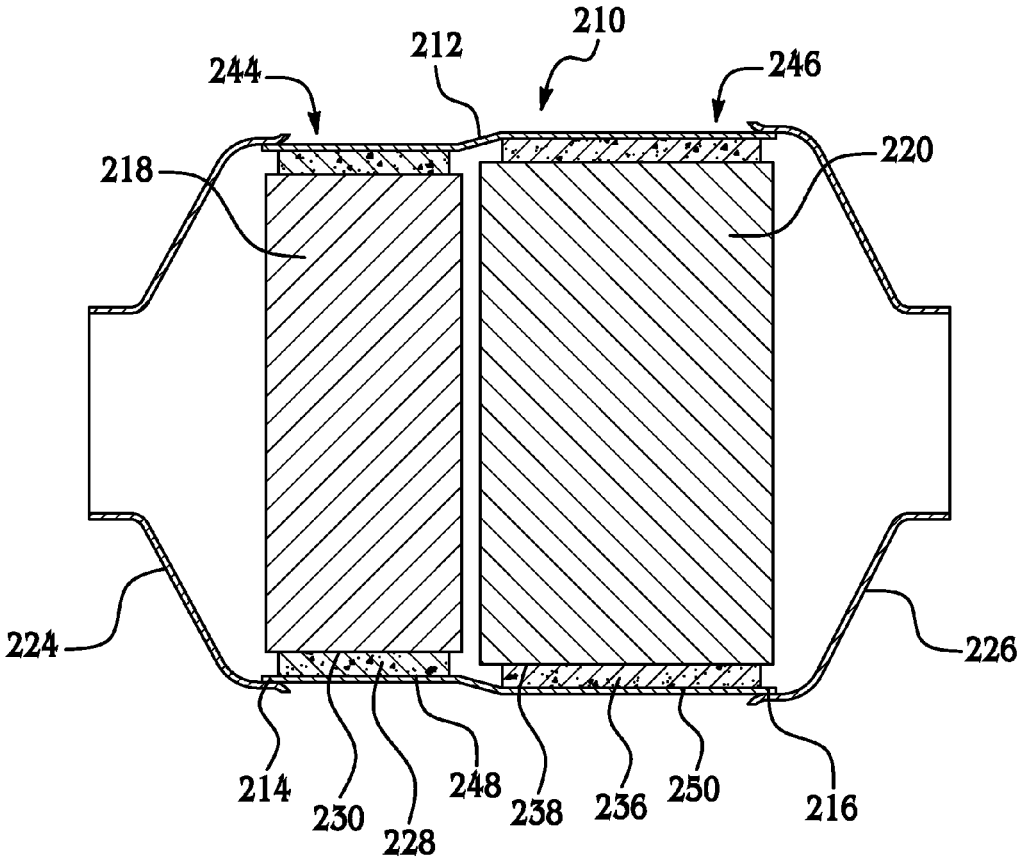

In accordance with another exemplary embodiment of the present invention, a catalytic converter is illustrated in FIG. 3. Exemplary catalytic converter 210 includes a housing or shell 212. Housing 212 has an inlet end 214 and an outlet end 216 and incorporates front and rear catalyst bricks 218, 220 that are nonuniform in both length and outer circumference. In the present exemplary embodiment, a rear shell portion 246 of housing 212 is larger in length and in outer periphery than a front shell portion 244 to accommodate the corresponding nonuniform dimensions of the front and rear catalyst bricks 218, 220. Thus, while the annular width between the interior surface of the housing and front catalyst brick 218 is substantially uniform with the annular width between the interior surface of the housing and rear catalyst brick 220, the cross-sectional length of the annular space between the interior surface of the housing and the rear catalyst brick is longer than the cross-sectional length of the annular space between the interior surface of the housing and the front catalyst brick.

Also depicted in FIG. 3 are first and second end cones 224, 226, each of which is secured to housing 112 after front and rear catalyst bricks 218, 120 are installed in the housing. First end cone 224 is configured to engage front shell portion 244 of housing 212, and second end cone 226 is configured to engage the larger outer periphery of rear shell portion 246.

In the exemplary embodiment illustrated in FIG. 3, front and rear bricks 218, 220 are retained in housing 212 and supported by front and rear independent insulating support mats 228, 236 respectively. Front support mat 228 is annularly wrapped around exterior surface 230 of front catalyst brick 218 and disposed in the annular space between the front catalyst brick and an interior surface 248 of front shell portion 244. Rear support mat 236 is annularly wrapped around exterior surface 238 of rear catalyst brick 220 and disposed in the annular space between the rear catalyst brick and an interior surface 250 of rear shell portion 246.

In the present exemplary embodiment, front catalyst brick 218 has a shorter length, smaller outer circumference, less volume, and less mass than rear catalyst brick 220. To account for these dissimilarities, front support mat 228 is configured to meet the specific thermal insulation and erosion requirements of front catalyst brick 218. Specifically, front support mat 228 is comprised of a premium, lower basis weight material and provided with a shorter length and smaller outer circumference than rear support mat 236. To meet the more exacting support requirements, as well as the specific thermal insulation and erosion requirements, of rear catalyst brick 220, rear support mat 236 is comprised of a different mat material and provided with a longer length and larger outer circumference than front support 228.

Therefore, in accordance with exemplary embodiments of the present invention, the use of multiple independent insulating support mats can alleviate problems such as maximum gap bulk density that are typically caused by variations in the annular space between the catalyst bricks and the housing. For instance, in alternative exemplary embodiments in which the peripheral dimensions of an exhaust treatment device housing do not vary in accordance with varying outer circumferences of multiple catalyst bricks that are installed within the housing, the independent support mats, in addition to being provided with a nonuniform lengths and outer peripheries or circumferences, could be provided with nonuniform annular widths and/or mat materials of having different basis weights to account for the dissimilarities in the corresponding annular spaces between the catalyst bricks and the housing.

This flexibility can permit exemplary embodiments of the present invention to be utilized to reduce installation and assembly costs. For instance, another non-limiting, exemplary process for installing the insulating support/catalyst brick subassembly into the housing is the "size-to-fit" process, which has been used to install two catalyst bricks in one step. In this process, the size of a given housing is varied in direct proportion to the size of a given catalyst brick. In this manner, a brick at the upper limit of the size tolerance range can be accommodated by building a housing that is the same amount larger than a nominal size housing as the large brick is bigger than a nominal size brick. This can allow for a desired or consistent amount of mat pressure to be applied to each brick, thereby allowing the shell to retain the bricks while not causing them to fracture during assembly or use.

Traditionally, the cost of adjusting the size of the housing relative to the size of the substrate in the size-to-fit has been significant, as has the cost and lead-time to purchase the necessary tooling. Exemplary embodiments of the present invention, however, allow for utilization of the size-to-fit method to assemble an exhaust treatment device having multiple catalysts with inconsistent dimensions without requiring a costly adjustment of the housing size yet still providing the desired and consistent amount of mat support to retain each of the dissimilar catalyst bricks with better control and less variation in pressure. This can be achieved in exemplary embodiments by varying the dimensions of the independent insulating support mats for each catalyst brick thereby allowing for the housing to retain its shell sizing.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. An exhaust treatment device, comprising:

a housing defining an axis with an inlet opening and an outlet opening with the openings being disposed along the axis;

a first catalyst brick and a second catalyst brick each having an inlet end and an outlet end, the first catalyst brick being disposed within a first segment adjacent the inlet opening of the housing and the second catalyst brick being disposed within a second segment adjacent the outlet opening of the housing with the segments being disposed along the axis, the first segment having an inner periphery that is not equal to an inner periphery of the second segment, the first and second catalyst bricks each having nonuniform dimensions with respect to one another, the first and second segments of the housing being independently dimensioned in proportion to the first and second catalyst bricks respectively;

a first insulating support cover disposed within the first segment of the housing in a first annular space between an inner surface of the housing and an exterior surface of the first catalyst brick with the first insulating support cover having a first material, a first basis weight, a first resistance to thermal gas erosion, and a first rate of thermal expansion; and a second insulating support cover disposed within the second segment of the housing in a second annular space between the inner surface of the housing and an exterior surface of the second catalyst brick with the second insulating support cover having a second material, a second basis weight, a second resistance to thermal gas erosion, and a second rate of thermal expansion, the first and second insulating support covers being independently dimensioned in proportion to the first and second catalyst bricks respectively;

wherein one or more of: the first and second materials are different from each other; the first basis weight is greater than the second basis weight; the first resistance to thermal gas erosion is greater than the second resistance to thermal gas erosion; and the first and second rates of thermal expansion are different from each other.

2. The exhaust treatment device of claim 1, wherein the first and second catalyst bricks are nonuniform in outer circumference with respect to one another.

3. The exhaust treatment device of claim 1, wherein the first and second catalyst bricks are nonuniform in length with respect to one another.

4. The exhaust treatment device of claim 1, wherein the first and second catalyst bricks are coated with a washcoat comprising a catalyst and expansion pressure applied to the first catalyst brick by the first insulating cover is less than or greater than expansion pressure applied to the second catalyst brick by the second insulating support cover.

5. The exhaust treatment device of claim 1, wherein the first catalyst brick is coated with a first washcoat that comprises a first catalyst specifically configured for the first catalyst brick, and the second catalyst brick is coated with a second washcoat that comprises a second catalyst specifically configured for the second catalyst brick, the first washcoat being different from the second washcoat.

6. The exhaust treatment device of claim 1, wherein the first insulating support cover is separated from the second insulating support cover via a gap in which a gas sensor is situated.

7. The exhaust treatment device of claim 1, wherein the inlet end of the first catalyst brick is adjacent to the inlet opening of the housing and the inlet end of the second catalyst brick is butted against the outlet end of the first catalyst brick.

8. The exhaust treatment device of claim 1, wherein the first insulating support cover is spaced and separate from the second insulating cover.

9. The exhaust treatment device of claim 1, wherein the first material of the entire portion of the first insulating support cover is different from the second material of the entire portion of the second insulating support cover.

10. The exhaust treatment device of claim 1, wherein the first resistance to thermal gas erosion of the entire portion of the first insulating support cover is greater from the second resistance to thermal gas erosion of the entire portion of the second insulating support cover.

11. An exhaust treatment device, comprising:

a housing defining an axis with an inlet opening and an outlet opening with the openings being disposed along the axis;

a first catalyst brick and a second catalyst brick each having an inlet end and an outlet end, the first catalyst brick being disposed within a first segment adjacent the inlet opening of the housing and the second catalyst brick being disposed within a second segment adjacent the outlet opening of the housing with the segments being disposed along the axis, a mass of the first catalyst brick being less than a mass of the second catalyst brick;

a first insulating support cover disposed within the first segment of the housing in a first annular space between an inner surface of the housing and an exterior surface of the first catalyst brick with the first insulating support cover having a first material, a first basis weight, a first resistance to thermal gas erosion, and a first rate of thermal expansion; and a second insulating support cover disposed within the second segment of the housing in a second annular space between the inner surface of the housing and an exterior surface of the second catalyst brick with the second insulating support cover having a second material, a second basis weight, a second resistance to thermal gas erosion, and a second rate of thermal expansion, the first and second insulating support covers being independently dimensioned in proportion to the first and second catalyst bricks respectively, the first segment of the housing being independently dimensioned in relation to the first catalyst brick and the first insulating support cover, and the second segment of the housing being independently dimensioned in relation to the second catalyst brick and the second insulating support cover wherein one or more of: the first and second materials are different from each other; the first basis weight is greater than the second basis weight; the first resistances to thermal gas erosion is greater than the second resistance to thermal gas erosion; and the first and second rates of thermal expansion are different from each other.

12. The exhaust treatment device of claim 11, wherein the first and second catalyst bricks each have nonuniform dimensions with respect to one another and the first and second insulating support covers each have nonuniform dimensions with respect to one another.

13. The exhaust treatment device of claim 11, wherein the first segment of the housing has an inner periphery that is not equal to an inner periphery of the second segment of the housing.

14. The exhaust treatment device of claim 11, wherein the first and second insulating support covers are independently configured to provide desired amounts of support to the first and second catalyst bricks respectively.

* * * * *